US005848721A

United States Patent [19]

Cornell et al.

[11] Patent Number: 5,848,721

[45] Date of Patent: Dec. 15, 1998

[54] DUAL STRAW/PRIZE DISPENSING DEVICE FOR BEVERAGE CONTAINER

[75] Inventors: Stephen W. Cornell, Naperville, Ill.; Peter F. Murphy, Grosse Pointe, Mich.; Jon Taylor, Chicago, Ill.

[73] Assignee: The PopStraw Company, LLC, Roseville, Mich.

[21] Appl. No.: 992,301

[22] Filed: Dec. 17, 1997

[51] Int. Cl.[6] ..... B65D 85/72

[52] U.S. Cl. ..... 220/706; 220/707; 220/709

[58] Field of Search ..... 220/706, 707, 220/708, 709

[56] References Cited

U.S. PATENT DOCUMENTS

| | | |
|---|---|---|
| 806,528 | 12/1905 | Dewender . |
| 942,306 | 12/1909 | Clarke . |
| 1,253,579 | 1/1918 | Deanes . |
| 1,309,994 | 7/1919 | McAuliffe . |
| 1,962,883 | 6/1934 | Tate et al. . |
| 1,997,914 | 4/1935 | Pollard . |
| 2,052,307 | 8/1936 | Kennedy . |
| 2,072,580 | 3/1937 | Correll . |
| 2,150,439 | 3/1939 | Hamilton . |
| 2,175,735 | 10/1939 | Banks . |
| 2,201,224 | 8/1940 | Daly . |
| 2,260,968 | 10/1941 | Cordis . |
| 2,279,396 | 4/1942 | Hanson, Jr. . |
| 2,392,479 | 1/1946 | Humbert . |
| 2,432,132 | 12/1947 | Allen . |
| 2,547,362 | 4/1951 | Berry . |
| 2,613,988 | 10/1952 | Jarbeau . |
| 2,748,968 | 6/1956 | Attler . |
| 2,799,439 | 7/1957 | Pugh, Sr. . |
| 2,805,809 | 9/1957 | Pugh . |
| 2,815,879 | 12/1957 | Hermes . |
| 2,837,234 | 6/1958 | Mainiere . |
| 2,844,267 | 7/1958 | Petriccione . |
| 2,867,536 | 1/1959 | Mead et al. . |
| 2,997,195 | 8/1961 | Yuen . |
| 3,071,303 | 1/1963 | Pugh . |
| 3,099,565 | 7/1963 | Neuhauser . |
| 3,101,855 | 8/1963 | Yuen . |
| 3,184,134 | 5/1965 | Cohen et al. . |
| 3,211,379 | 10/1965 | Burton . |
| 3,215,329 | 11/1965 | Pugh, Sr. . |
| 3,220,587 | 11/1965 | Griffin et al. . |
| 3,226,001 | 12/1965 | Sequeira . |
| 3,291,331 | 12/1966 | Grisham et al. . |
| 3,298,577 | 1/1967 | Chlystun . |
| 3,303,984 | 2/1967 | Jurena . |
| 3,303,985 | 2/1967 | Prokes et al. . |
| 3,325,076 | 6/1967 | Soucy . |
| 3,326,695 | 6/1967 | Neuhauser . |
| 3,409,224 | 11/1968 | Harp et al. . |
| 3,438,527 | 4/1969 | Gamblin, Jr. . |
| 3,517,884 | 6/1970 | Horvath . |
| 3,542,278 | 11/1970 | Deaver . |
| 3,568,870 | 3/1971 | Elston . |
| 3,623,632 | 11/1971 | Chang . |
| 3,656,654 | 4/1972 | Brinkley, III . |

(List continued on next page.)

*Primary Examiner*—Joseph M Moy
*Attorney, Agent, or Firm*—Harness, Dickey & Pierce, P.L.C.

[57] ABSTRACT

A beverage container has a straw-dispensing mechanism that is disposed within the container to bring a straw or prize delivery device into alignment with the orifice in the top of the container. When the orifice is opened, the straw or prize delivery device elevates through the orifice to become accessible to the user. In one embodiment, two straws engage a floating member which is urged against the lid of the container. When the container is opened by deflecting a closure tab into the container, the closure tab engages a cam surface on the floating member and imparts rotational motion to the floating member. The floating member rotates until one of the straws is aligned with the open orifice and a buoyant member associated with the straw elevates the straw through the orifice. In a second embodiment, one of the straws is replaced with the prize delivery device.

26 Claims, 4 Drawing Sheets

U.S. PATENT DOCUMENTS 3,717,476 2/1973 Harvey .
3,746,197 7/1973 Sather .
3,776,458 12/1973 Chunga, Sr. .
3,780,944 12/1973 Zubalik .
3,799,914 3/1974 Schmit et al. .
4,109,817 8/1978 Payne et al. .
4,194,674 3/1980 Pearson .
4,228,913 10/1980 Mack et al. .
4,251,019 2/1981 Cone .
4,305,521 12/1981 Komatsuta et al. .
4,356,927 11/1982 Cooper et al. .
4,379,511 4/1983 del Fabro .
4,411,359 10/1983 Franco .
4,582,213 4/1986 Park et al. .
4,688,721 8/1987 Inaba .
4,690,294 9/1987 Jones .
4,709,829 12/1987 Johnson et al. .
4,728,001 3/1988 Serba .
4,733,785 3/1988 Turner, Jr. et al. .
4,736,887 4/1988 Inaba .
4,744,477 5/1988 Wofford .
4,792,083 12/1988 Yassur .
4,826,034 5/1989 Forbes .
4,877,148 10/1989 Larson et al. .
4,892,187 1/1990 Stein .
4,909,437 3/1990 Kang .
4,911,315 3/1990 Shrum .
4,911,320 3/1990 Howes .
4,923,083 5/1990 Forbes .
5,046,631 9/1991 Goodman .
5,054,639 10/1991 Ahn .
5,056,659 10/1991 Howes et al. .
5,056,681 10/1991 Howes .
5,071,019 12/1991 Sizemore .
5,099,232 3/1992 Howes .
5,114,074 5/1992 Frauenthal et al. .
5,148,971 9/1992 Ahn .
5,160,058 11/1992 Ahn .
5,172,827 12/1992 Chang et al. .
5,183,183 2/1993 Hernandez .
5,253,779 10/1993 Lee .
5,283,567 2/1994 Howes .
5,431,297 7/1995 Rosello .
5,439,103 8/1995 Howes .
5,482,158 1/1996 Plester .
5,482,202 1/1996 Wen .
5,564,591 10/1996 Christine et al. .
5,597,089 1/1997 Smith .

DUAL STRAW/PRIZE DISPENSING DEVICE FOR BEVERAGE CONTAINER

FIELD OF THE INVENTION

The present invention relates to beverage containers having a self-contained straw delivery device. More particularly, the present invention relates to beverage containers having a self-contained dual straw or straw and prize delivery device which become accessible to the user when the beverage container is opened.

BACKGROUND AND SUMMARY OF THE INVENTION

Currently, beverage containers are manufactured, filled, and sealed in a high-speed automated process. This process includes manufacturing a separate body for containing the fluid or beverage and a separate lid for sealing the open end of the body. During manufacture of the filled beverage container, a manufacturing operation known as "seaming" places the lid on a filled can body and seals its perimeter. At present, known seaming operations pass the lids horizontally across the top of the filled can bodies at a vertical distance of only a few millimeters above the top edge of the can body. Once positioned on top of the can body, the seaming operation seals the fluid or beverage within the beverage container. This seaming operation involves the use of very expensive high-speed machinery and tooling or retooling this high-speed machinery to accommodate a self-contained drinking straw or prize delivery device is not a practical solution.

Various designs have been proposed in the prior art for placing a straw within a beverage can that becomes accessible to the user when the tab in the lid of the can is deflected into the interior to open the can. The vast majority of these designs can be categorized into two groups. The first group comprises designs wherein the straw is installed within the can so as to be prealigned with the tab opening. Thus, when the tab is opened, access to the straw is presented. The practical disadvantage with this approach is that the bodies and lids of the cans are randomly oriented during the present day seaming operations. Consequently, any design that requires prealignment of the straw with the opening in the lid is not readily adaptable to the existing high-speed filling equipment.

The second group of designs generally involves the mounting or attachment in some manner of the straw to the underside of the lid such that when the can is opened, the end of the straw is drawn through or otherwise made accessible through the opening. These designs are also not readily adaptable to the existing high-speed filling canning equipment due to the fact, as noted above, the commercial filling processes pass the lid within a few millimeters of the top of the can during the high-speed seaming operation. Consequently, any structure that is attached or otherwise appended to the underside of the lid will disrupt the seaming process and thus require expensive retooling of the existing high-speed machinery.

A different approach for this concept is disclosed in U.S. Pat. No. 5,547,103 which is assigned to the assignee of the present invention. This patent discloses various embodiments of a beverage container having a straw-dispensing mechanism that relies upon user manipulation of the container and the forces of gravity to bring the straw into alignment with the opening in the lid. The user merely tilts the beverage container, preferably prior to opening, to cause the mechanism within the container to bring the straw into general alignment with the tab. Once the container is opened, further minor manipulation or tilting of the container may be necessary to complete the alignment of the straw with the open orifice in the lid.

Yet another approach for this concept is disclosed in U.S. Pat. Nos. 5,244,112; 5,080,247 and 4,930,652 which are also assigned to the assignee of the present invention. These patents describe various embodiments of a straw-dispensing mechanism that is disposed within the body of the container which operate to rotate the straw into alignment beneath the open orifice of a beverage container. In particular, these designs respond to the inward deflection of the closure tab into the body of the container to actuate or drive a rotating mechanism which aligns the straw with the open orifice. While these designs remain technologically and commercially viable, the continued development of straw-dispensing mechanisms is directed to simpler and lower cost mechanisms which can be relied upon to consistently align the drinking straw with the open orifice in the beverage can once the orifice in the beverage can has been opened.

In this regard, the present invention discloses a beverage container having a straw-dispensing mechanism which includes a contoured or shaped cam surface which operates to cause rotation of the drinking straw to align the drinking straw with the orifice. A first embodiment of the present invention employs a float which supports and positions two drinking straws at a distance radially which is equal to the radial position of the orifice in the can lid. A cam surface located on the upper surface of the float reacts with the inward deflected tab upon opening of the beverage can to rotate one of the drinking straws to a position in alignment with the now open orifice.

A second embodiment employs a float which supports and positions a drinking straw and a prize delivery device at a distance radially which is equal to the radial position of the orifice in the can lid. The cam surface located on the upper surface of the float reacts with the inward deflected tab upon opening of the beverage can to rotate either the drinking straw or the prize delivery device to a position in alignment with the now open orifice. Instructions on the one of the drinking straw and price delivery device rotated to alignment with the orifice instructs the user to manipulate the float to rotate the other of the drinking straw and prize delivery device into alignment with the orifice.

Thus, it is an object of the present invention to provide a beverage container with a self-contained dual straw or straw and prize dispensing mechanism that is compatible for manufacture with existing filling equipment.

In addition, it is an object of the present invention to provide such a beverage container with a self-contained dual straw or straw and prize dispensing mechanism that is simple in design, utilizes a minimum of material, is inexpensive to manufacture, and requires relatively inexpensive equipment to assemble and insert into the beverage containers.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENTS

Figure 1:
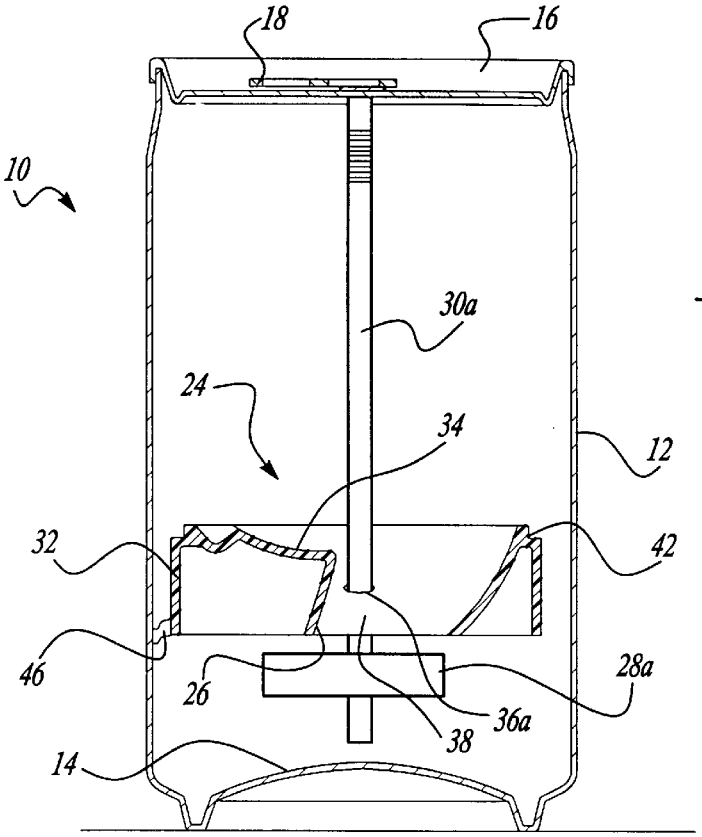
FIG. 1 is a vertical sectional view of a beverage can containing a straw-dispensing mechanism according to a first embodiment of the present invention.
Figure 2:
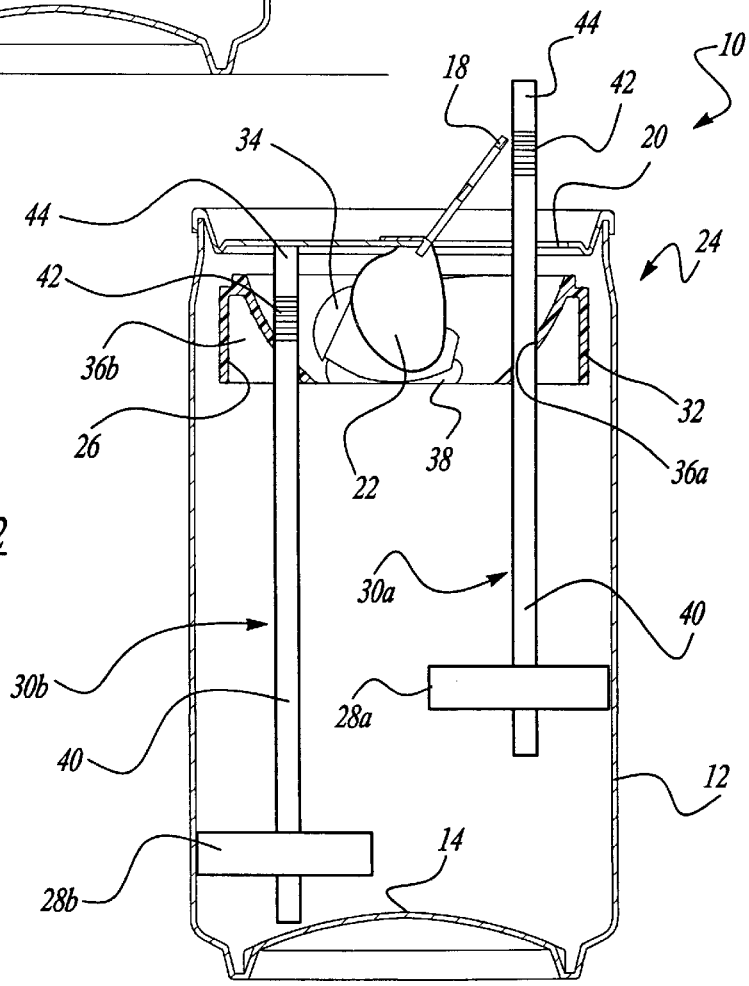
FIG. 2 is a vertical sectional view of the beverage can shown in FIG. 1 after the float has been rotated 90° illustrating one straw ascending through the orifice in the lid of the can.
Figure 3:
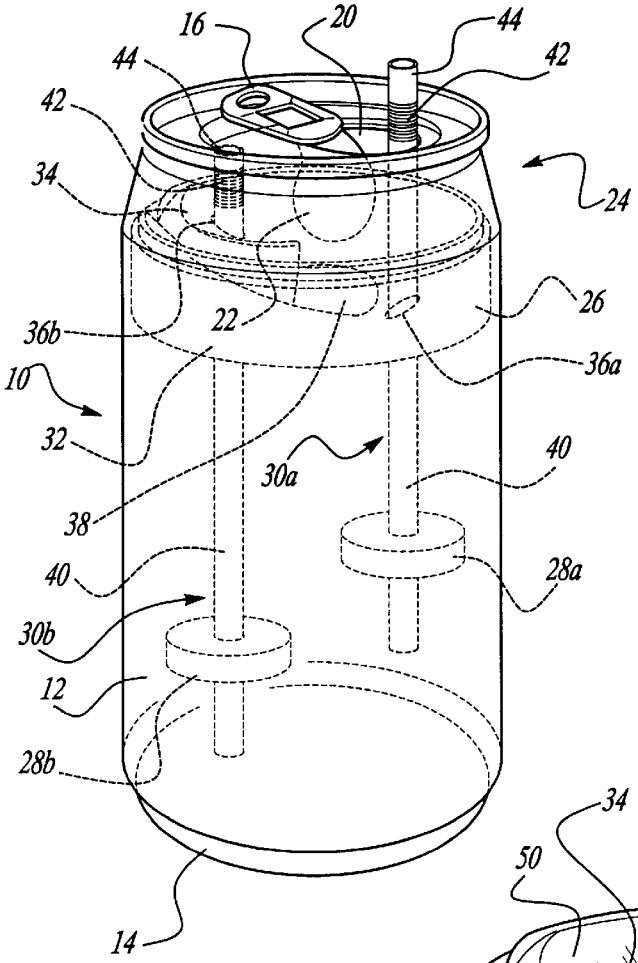
FIG. 3 is a front perspective view of the beverage can shown in FIGS. 1 and 2 illustrating one straw in the extended position.
Figure 4:
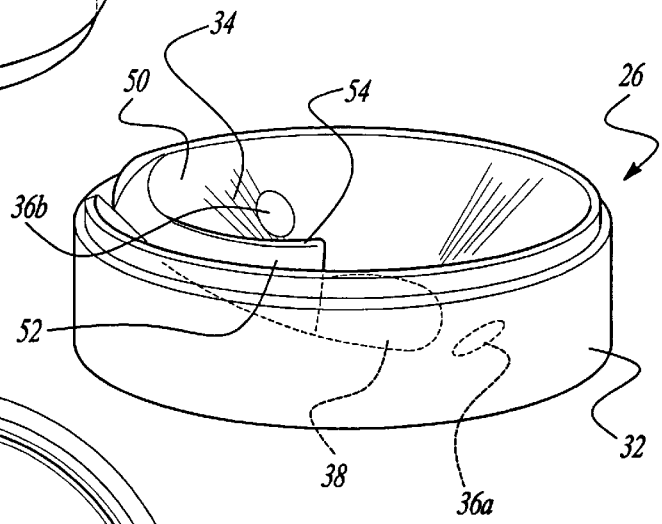
FIG. 4 is a perspective view of the floating disk shown in FIGS. 1–3.
Figure 5:
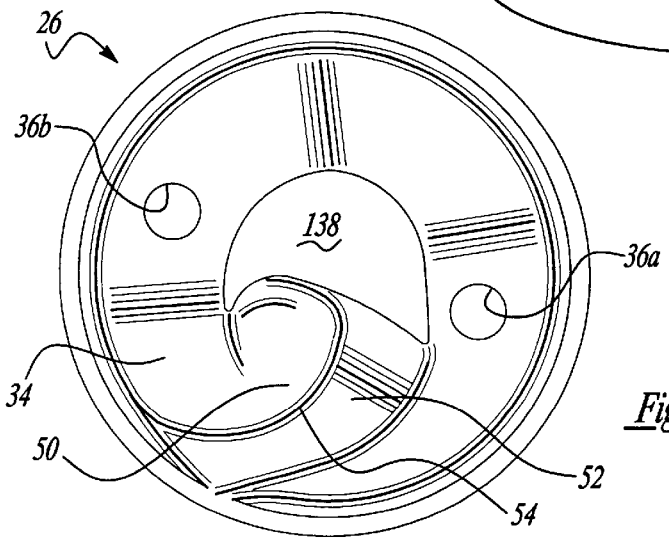
FIG. 5 is a plan view of the floating disk shown in FIG. 4.
Figure 6:
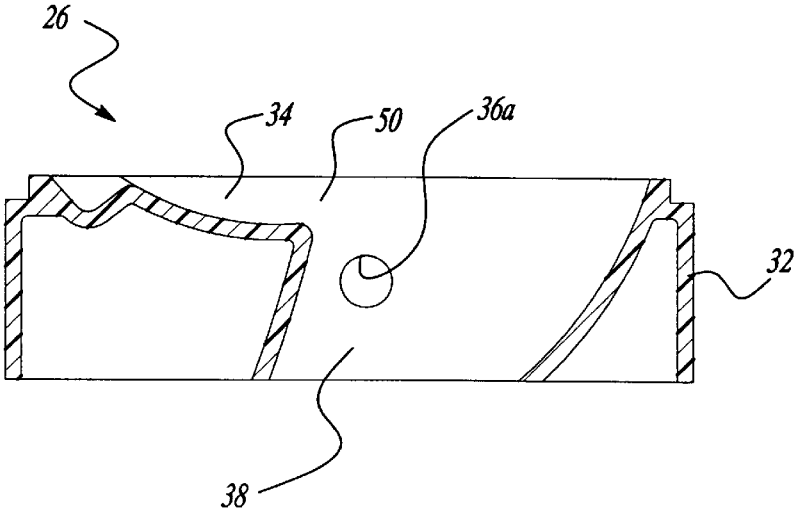
FIG. 6 is a vertical sectional view of the floating disk shown in FIGS. 4 and 5.
Figure 7:
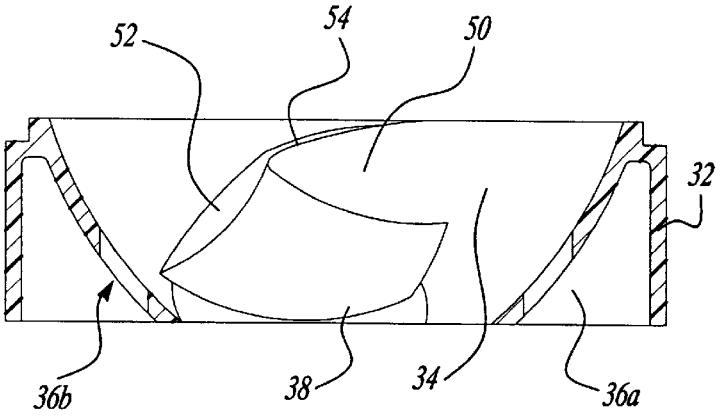
FIG. 7 is a vertical sectional view of the floating disk shown in FIG. 6 rotated by 90°.

Referring now to the drawings in which like reference numerals designate like or corresponding parts throughout the several views, there is shown in FIGS. 1–3 a beverage can having a straw dispensing mechanism in accordance with the present invention which is designated generally by reference numeral 10. Beverage can 10 comprises an aluminum, steel or plastic container having a cylindrical body 12 with a closed bottom 14 and an upper lid 16. Lid 16 is joined to body 12 using a seaming operation as is well known in the art. Lid 16 includes an actuating member or lever ring 18 pivotally secured to lid 16. Lever ring 18 is adapted when actuated to open an orifice 20 in lid 16 by deflecting a closure tab 22 into the interior of beverage can 10. Closure tab 22 is formed by score lines in lid 16 which enable a controlled portion of closure tab 22 to break free from lid 16 when lever ring 18 is actuated against tab 22 by an individual. As the user lifts one end of ring 18 to its maximum extent, the opposite end pushes against closure tab 22. Alternatively, the tab could be designed to break free when depressed by the user's finger or by the use of a portable tool. In these types of closure tabs, lever ring 18 may be omitted. Closure tab 22 is typically designed via the score lines to deflect downwardly and toward one side of orifice 20 to fully open orifice 20 and facilitate the free flow of liquid from beverage can 10 through orifice 20.

Beverage can 10 further comprises a straw dispensing mechanism 24 which is comprised of a floating member 26, two buoyant members 28*a*, 28*b* and two drinking straws 30*a*, 30*b*. Floating member 26 defines an outer cylindrical surface 32, a cam surface 34, and two straw apertures 36*a*, 36*b*. Floating member 26 is manufactured from a material which will float within the liquid contained inside beverage can 10 and thus will position itself adjacent to lid 16 in a filled beverage can 10.

Outer cylindrical surface 32 of floating member 26 is sized slightly smaller than the internal diameter of can body 12. Thus, floating member 26 is free to move axially within beverage can 10 and will be urged against lid 16 due to the buoyant force acting on floating member 26. The height of surface 32 is chosen to work in conjunction with straws 30*a*, 30*b* to limit the tilting of floating member 26 in order to maintain straws 30*a*, 30*b* in a generally vertical position as shown in the drawings. Apertures 36*a*, 36*b* extend vertically through floating member 26. The radial positioning of apertures 36*a*, 36*b* position one of apertures 36*a*, 36*b* in direct vertical alignment with orifice 20 when that aperture 36*a*, 36*b* is circumferentially aligned with orifice 20. A centrally located aperture 38 allows for the filling of the volume of beverage can 10 located below floating member 26. Alternatively, additional passages through floating member 26 or the clearance between floating member 26 and the interior of can body 12 may be used to facilitate the filling of beverage can 10.

Each of drinking straws 30*a*, 30*b* includes a lower tubular portion 40, a pull-out flexible convoluted section 42 and an upper tubular portion 44. Lower tubular portions 40 of drinking straws 30*a*, 30*b* extend through apertures 36*a*, 36*b* in floating member 26 respectively. Apertures 36*a*, 36*b* are slightly larger than lower tubular portion 40 and thus slidingly receive lower tubular portion 40. Thus, floating member 26 is free to move vertically within beverage can 10 with respect to straws 30*a*, 30*b*. Buoyant members 28*a*, 28*b* are attached to the lower end of lower tubular portion 40 to urge straws 30*a*, 30*b* in an upward direction. The diameter of each buoyant member 28*a*, 28*b* is chosen such that when the outer edge of buoyant member 28*a*, 28*b* is in contact with the inside wall of can body 12, straws 30*a*, 30*b* are positioned generally vertically within beverage can 10. Thus, buoyant members 28*a*, 28*b* will act as torque arms to reduce the amount of tilting of floating member 26 during the opening of beverage can 10 as will be described later herein.

FIG. 1 illustrates beverage can 10 and straw dispensing mechanism 24 immediately after the filling and seaming operation have been performed. Drinking straw 30*a* extends from bottom 14 of can body 12 vertically upward through aperture 36*a* of floating member 26 towards lid 16. The circumferential positioning of straw 30*a* in relation to orifice 20 (FIG. 2) occurs randomly due to the filling and seaming processes for beverage can 10. To prevent floating member 26, buoyant members 28*a*, 28*b* and straws 30*a*, 30*b* from elevating during the can filling and seaming processes, and thus possibly interfering with these processes, a small amount of soluble adhesive 46, such as glucose or thixotropic gel, is preferably applied to temporarily bond floating member 26 and buoyant members 28*a*, 28*b* to can body 12. Another option would be to have floating member 26 retain both buoyant members 28*a*, 28*b* and straws 30*a*, 30*b* within beverage container 10. In addition, the location of floating member 26 toward the bottom of can body 12 minimizes the volume of beverage can 10 located below floating member 26 to simplify the filling operation. Accordingly, after the filling and seaming processes are complete, adhesive 46 will gradually dissolve and thereby enable floating member 26 to float upwardly to be urged against lid 16 and enable buoyant members 28*a*, 28*b* and straws 30*a*, 30*b* to float freely upward until straws 30*a*, 30*b* contact lid 16 as shown in FIG. 1.

FIGS. 2–3 illustrate beverage can 10 and straw dispensing mechanism 24 after lever ring 18 has pushed closure tab 22 into the interior of beverage can 10 to open orifice 20. The deflection of closure tab 22 from its closed (generally horizontal) position as shown in FIG. 1 to its open (generally vertical) position as shown in FIGS. 2 and 3 results in engagement between closure tab 22 and floating member 26 which imparts rotational movement to floating member 26, buoyant members 28*a*, 28*b* and straws 30*a*, 30*b*. Floating member 26 will rotate until one of straws 30*a*, 30*b* is aligned with open orifice 20. When one of straws 30*a*, 30*b* is aligned with orifice 20, the associated buoyant member 28*a*, 28*b* will push that straw 30*a*, 30*b* upward through orifice 20 to provide accessibility to the straw 30*a*, 30*b* by the user of beverage can 10.

At this point, the user may elect to commence drinking through straw 30*a*, 30*b* or withdraw straw 30*a*, 30*b* further from its orifice 20 in lid 16. Buoyant members 28*a,* 28*b* are formed with sufficient flexibility and the interface between straws 30*a,* 30*b* and buoyant members 28*a,* 28*b* may be sufficiently strong to retain buoyant members 28*a,* 28*b* on straws 30*a,* 30*b* when straw 30*a,* 30*b* is pulled upward causing straw 30*a,* 30*b* and buoyant member 28*a,* 28*b* to pass through floating member 26. Alternatively, buoyant members 28*a,* 28*b* can be designed to separate from straws 30*a,* 30*b*. This would require the size of buoyant members 28*a,* 28*b* to be such that they would not pass through orifice 20 or aperture 38. Convoluted section 42 can be extended regardless of whether or not straw 30*a,* 30*b* extends through aperture 36*a,* 36*b,* to allow the user to reach fully to bottom 14 of beverage can 10.

Referring now to FIGS. 4–7, floating member 26 is illustrated. Floating member 26 includes outer cylindrical surface 32, cam surface 34, straw apertures 36*a,* 36*b* and central aperture 38 as detailed above. Cam surface 34 defines a first contoured surface 50 and a second contoured surface 52. Contoured surfaces 50 and 52 form bidirectional cam surfaces which will rotate floating member 26 clockwise or counterclockwise depending on whether contoured surface 50 or contoured surface 52 is engaged by closure tab 22 (FIG. 3). The incorporation of two contoured surfaces 50 and 52 limits the maximum amount of rotation of floating member 26 to about 90° in order to align one of straws 30*a,* 30*b* with orifice 20 (FIG. 3). A ridge 54 separates contoured surface 50 from contoured surface 52 at one end while the opposite ends of surfaces 50 and 52 blend together as shown in the drawings.

During the opening of beverage can 10 closure tab 22 engages either contoured surface 50 or 52 of cam surface 34 to impart rotational movement to floating member 26, buoyant members 28*a,* 28*b* and straws 30*a,* 30*b*. In order to ensure rotational movement of floating member 26 and to avoid excessive tipping of floating member 26, straws 30*a,* 30*b* and buoyant members 28*a,* 28*b* may act as torque arms to stabilize floating member 26 and limit the amount of its tipping. As detailed above, the diameter of buoyant members 28*a,* 28*b* are chosen such that when the outer circumferential edge of buoyant members 28*a,* 28*b* are in contact with the inside wall of can body 12, straws 30*a,* 30*b* are positioned generally vertically within beverage can 10. Any tilting of floating member 26 will be resisted by straws 30*a,* 30*b* and buoyant members 28*a,* 28*b* acting between the sidewall of can body 12 and the interior surface of apertures 36*a,* 36*b* of floating member 26. The use of straws 30*a,* 30*b* and buoyant members 28*a,* 28*b* as torque arms allow for the shortening of the overall height of cylindrical surface 32 of floating member 26.

Figure 8:
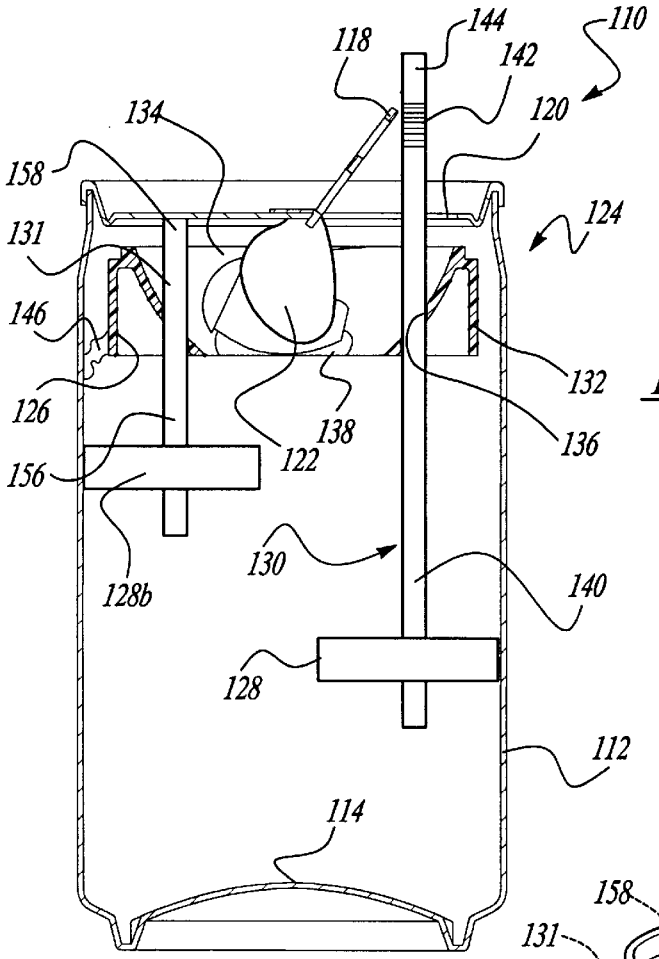
FIG. 8 is a vertical sectional view of a beverage can containing a straw-dispensing mechanism according to a second embodiment of the present invention.
Figure 9:
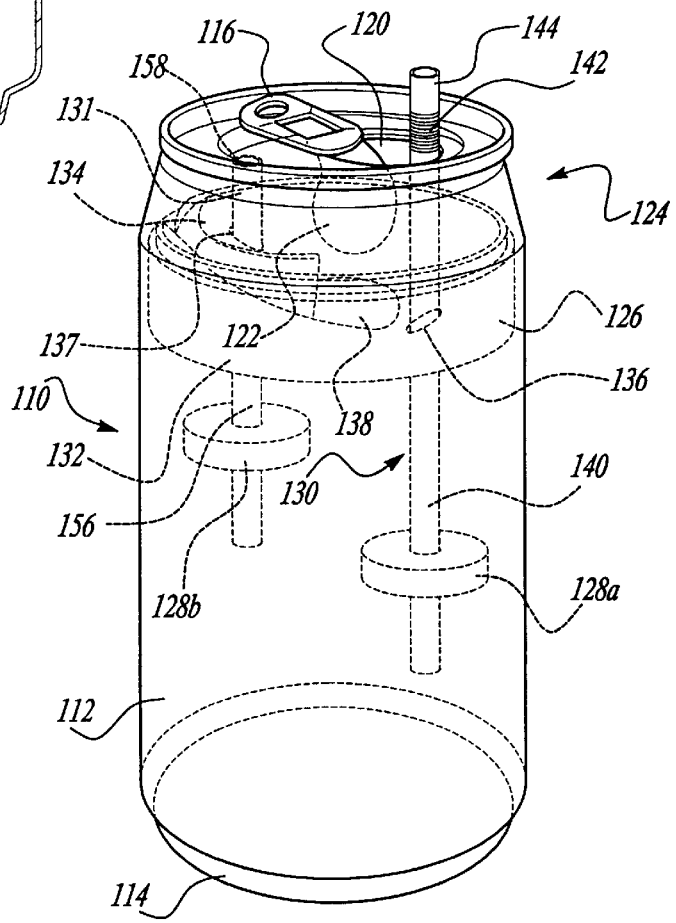
FIG. 9 is a front perspective view of the beverage can shown in FIG. 8.

Referring now to FIGS. 8 and 9 there is shown a beverage can having a straw dispensing mechanism in accordance with another embodiment of the present invention which is designated generally by reference numeral 110. Beverage can 110 comprises an aluminum, steel or plastic container having a cylindrical body 112 with a closed bottom 114 and an upper lid 116. Lid 116 is joined to body 112 using a seaming process as is well known in the art. Lid 116 includes an actuating member or lever ring 118 pivotally secured to lid 116. Lever ring 118 is adapted when actuated to open an orifice 120 in lid 116 by deflecting a closure tab 122 into the interior of beverage can 110. Closure tab 122 is formed by score lines in lid 116 which enable a controlled portion of closure tab 122 to break free from lid 116 when lever ring 118 is actuated against tab 122 by a user. As the user lifts one end of ring 118, the opposite end pushes against closure tab 122. Alternatively, the tab could be designed to break free when depressed by the user's finger or by the use of a portable tool. In these types of closure tabs, lever ring 118 may be omitted. Closure tab 122 is typically designed via the score lines to deflect downwardly and towards one side of orifice 120 to fully open orifice 120 and facilitate the free flow of liquid from beverage can 110 through orifice 120.

Beverage can 110 further comprises a straw dispensing mechanism 124 which is comprised of a floating member 126, two buoyant members 128*a,* 128*b,* a drinking straw 130 and a prize delivery device 131. Floating member 126 defines an outer cylindrical surface 132, a cam surfaces 134, a straw aperture 136, and a prize delivery device aperture 137.

Floating member 126 is manufactured from a material which will float within the liquid contained inside beverage can 110 and thus will position itself adjacent to lid 116 in a filled beverage can 110. Outer cylindrical surface 132 of floating member 126 is sized slightly smaller than the internal diameter of can body 112. Thus, floating member 126 is free to move axially within beverage can 110 and will be urged against lid 116 due to the buoyant force acting on floating member 126. The height of surface 132 is chosen to work in conjunction with straw 130 and prize delivery device 131 to limit the tilting of floating member 126 in order to maintain straw 130 in a generally vertical position as shown in the drawings. Apertures 136 and 137 extend vertically through floating member 126. The radial positioning of apertures 136 and 137 position one of apertures 136 and 137 in direct vertical alignment with orifice 120 when that aperture 136, 137 is circumferentially aligned with orifice 120. A centrally located aperture 138 allows for the filling of the volume of beverage can 110 located below floating member 126. Alternatively, additional passages through floating member 126 or the clearance between floating member 126 and the interior of can body 112 may be used to facilitate the filling of beverage can 110.

Drinking straw 130 includes a lower tubular portion 140, a pull-out flexible convoluted section 142 and an upper tubular portion 144. Lower tubular portion 140 of drinking straw 130 extends through aperture 136 in floating member 126. Aperture 136 is slightly larger than lower tubular portion 140 and thus slidingly receives lower tubular portion 140. Thus, floating member 126 is free to move vertically within beverage can 110 with respect to straw 130. Buoyant member 128 is attached to the lower end of lower tubular portion 140 to urge straw 130 in an upward direction. The diameter of buoyant member 128*a* is chosen such that when the outer edge of buoyant member 128*a* is in contact with the inside wall of can body 112, straw 130 is positioned generally vertically within beverage can 110. Thus, buoyant member 128*a* will act as a torque arm to reduce the amount of tilting of floating member 126 during the opening of beverage can 110 as will be described later herein.

Prize delivery device 131 includes a lower tubular portion 156 and an upper tubular portion 158. Lower tubular portion 156 of prize delivery device 131 extends through aperture 137 in floating member 126. Aperture 137 is slightly larger than lower tubular portion 156 and thus slidingly receives lower tubular portion 156. Thus, floating member 126 is free to move vertically within beverage can 110 with respect to prize delivery device 131. Buoyant member 128*b* is attached to the lower end of lower tubular portion 156 to urge prize delivery device 131 in an upward direction. The diameter of buoyant member 128*b* is chosen such that when the outer edge of buoyant member 128*b* is in contact with the inside wall of can body 112, prize delivery device 131 is positioned generally vertically within beverage can 110. Thus, buoyant member 128*b* will act as a torque arm to reduce the amount of tilting of floating member 126 during the opening of beverage can 110 as will be described later herein.

Prize delivery device 131 is preferably sealed at both ends to enclose a prize or a notice of a prize therein. This sealed arrangement will also contribute to the buoyancy of the prize delivery device 131. Alternatively, prize notification information may be printed on the external surface of prize delivery device 131. In either case, the prize delivery device 131 and straw 130 will contain instructions instructing a user of beverage can 110 that the other of the straw 130 and prize delivery device 131 is available and that access thereto may be gained by further rotating floating member 126. Preferably, subsequent rotation of floating member 126 is performed through manipulation of floating member 126 with the accessible one of the straw 130 and prize delivery device 131. Another alternative would be to have instructions relating to how to obtain the straw and/or the prize delivery device printed on beverage can 110.

Immediately after the filling and seaming operation have been performed, drinking straw 130 and prize delivery device 131 extend from bottom 114 of can body 112 vertically upward through apertures 136 and 137 of floating member 126 towards lid 116. The circumferential positioning of straw 130 and prize delivery device 131 in relation to orifice 120 occurs randomly due to the filling and seaming processes for beverage can 110. To prevent floating member 126, buoyant members 128*a*, 128*b*, straw 130 and prize delivery device 131 from elevating during the can filling and seaming processes, and thus possibly interfering with these processes, a small amount of soluble adhesive 146, such as glucose or thixotropic gel, is preferably applied to temporarily bond floating member 126 and buoyant members 128*a*, 128*b* to can body 112. Another option would be to locate floating member 126 toward the bottom 114 of can body 112. Floating member 126 would then retain buoyant members 128*a*, 128*b*, straw 130 and prize delivery device 131 within beverage container 110. In addition, the location of floating member 126 toward the bottom of can body 112 would minimize the volume of beverage can 110 located below floating member 126 to simplify the filling operation. Accordingly, after the filling and seaming processes are complete, adhesive 146 will gradually dissolve and thereby enable floating member 126 to float upwardly to be urged against lid 116 and enable buoyant members 128*a*, 128*b*, straw 130 and prize delivery device 131 to float freely upward until straw 130 and prize delivery device 131 contact lid 116. The circumferential positioning of straw 130 and prize delivery device 131 in relation to orifice 120 occurs randomly due to both the filling and seaming processes and any rotation which may occur as floating member 126 moves upward from its retained position during filling is acceptable.

FIGS. 8 and 9 illustrate beverage can 110 and straw dispensing mechanism 124 after lever ring 118 has pushed closure tab 122 into the interior of beverage can 110 to open orifice 120. The deflection of closure tab 122 from its closed (generally horizontal) position to its open (generally vertical) position results in engagement between closure tab 122 and floating member 126 which imparts rotational movement to floating member 126, buoyant members 128*a*, 128*b*, straw 130 and prize delivery device 131. Floating member 126 will rotate until one of straw 130 and prize delivery device 131 is aligned with open orifice 120. When straw 130 or prize delivery device 131 is aligned with orifice 120, the associated buoyant member 128*a*, 128*b* will push straw 130 or prize delivery device 131 upward through orifice 120 to provide accessibility to straw 130 or prize delivery device 131 by the user of beverage can 110.

At this point, the user may elect to commence drinking through straw 130 or withdraw straw 130 or prize delivery device 131 further from orifice 120 in lid 116. Buoyant members 128*a*, 128*b* are formed with sufficient flexibility and the interface between straw 130 and buoyant member 128*a* and prize delivery device 131 and buoyant member 128*b* is sufficiently strong to retain buoyant members 128*a*, 128*b* on straw 130 and prize delivery device 131 when straw 130 or prize delivery device 131 is pulled upward causing straw 130 or prize delivery device 131 and buoyant member 128*a*, 128*b* to pass through floating member 126. Alternatively, the buoyant members 128*a*, 128*b* can be designed to separate from straw 130 and prize delivery device 131. This would require the size of buoyant members 128*a*, 128*b* to be such that they would not pass through orifice 120 or aperture 138.

After the straw 130 or prize delivery device 131 is removed from floating member 126, the user may manipulate floating member 126 with straw 130 or prize delivery device 131 or otherwise to rotate the other of straw 130 and prize delivery device 131 into alignment with orifice 120. At this point, buoyant member 128*a*, 128*b* will push straw 130 or prize delivery device 131 upward through orifice 120 to provide accessibility to straw 130 or prize delivery device 131 by the user of beverage can 110.

While the above detailed description describes the preferred embodiment of the present invention, it should be understood that the present invention is susceptible to modification, variation and alteration without deviating from the scope and fair meaning of the subjoined claims.

What is claimed is:

1. A beverage container comprising:

a body with a closed bottom end and a top end;

a lid closing said top end of said body, said lid defining an orifice;

a closure tab disposed within said orifice;

a floating member disposed within said body, said floating member being urged against said lid when a liquid is disposed within said container;

two devices supported by said floating member; and means for deflecting said closure tab into said container to open said orifice, said closure tab engaging said floating member to move said floating member and thereby align one of said devices with said orifice.

2. The beverage container according to claim 1 wherein each of said two devices is a straw.

3. The beverage container according to claim 2 wherein, said engagement between said floating member and said closure tab causes rotational movement of said floating member.

4. The beverage container according to claim 3 wherein, said floating member defines a pair of apertures, said straws being slidingly received within said apertures.

5. The beverage container according to claim 4 further comprising a buoyant member associated with each of said straws, said buoyant member elevating said one of said straws through said orifice when said straw is aligned with said orifice.

6. The beverage container according to claim 5 wherein, said buoyant members contact said can body to limit tilting of said floating member during engagement of said closure tab with said floating member.

7. The beverage container according to claim 2 further comprising means for temporarily securing said floating member to said body.

8. The beverage container according to claim 2 wherein, said floating member defines a cam surface for engagement with said closure tab.

9. The beverage container according to claim 8 wherein said cam surface defines a first and a second contoured surface for engagement with said closure tab.

10. The beverage container according to claim 9 wherein, said engagement between said closure tab and said first contoured surface causes clockwise rotation of said floating member and engagement between said closure tab and said second contoured surface causes counterclockwise rotation of said floating member.

11. The beverage container according to claim 10 wherein, said floating member defines a pair of apertures, said straws being slidingly received within said apertures.

12. The beverage container according to claim 11 further comprising a buoyant member associated with each of said straws, said buoyant member elevating said one of said straws through said orifice when said straw is aligned with said orifice.

13. The beverage container according to claim 1 wherein one of said devices is a straw and the other of said devices is a prize delivery device.

14. The beverage container according to claim 13 wherein, said engagement between said floating member and said closure tab causes rotational movement of said floating member.

15. The beverage container according to claim 14 wherein, said floating member defines a pair of apertures, said straw and said prize delivery device being slidingly received within said apertures.

16. The beverage container according to claim 15 further comprising a buoyant member associated with each of said straw and prize delivery device, said buoyant member elevating said straw through said orifice when said straw is aligned with said orifice and elevating said prize delivery device through said orifice when said prize delivery device is aligned with said orifice.

17. The beverage container according to claim 16 wherein, said buoyant members contact said can body to limit tilting of said floating member during engagement of said closure tab with said floating member.

18. The beverage container according to claim 13 further comprising means for temporarily securing said floating member to said body.

19. The beverage container according to claim 13 wherein, said floating member defines a cam surface for engagement with said closure tab.

20. The beverage container according to claim 19 wherein, said cam surface defines a first and a second contoured surface for engagement with said closure tab.

21. The beverage container according to claim 20 wherein, said engagement between said closure tab and said first contoured surface causes clockwise rotation of said floating member and engagement between said closure tab and said second contoured surface causes counterclockwise rotation of said floating member.

22. The beverage container according to claim 21 wherein, said floating member defines a pair of apertures, said straw and prize delivery device being slidingly received within said apertures.

23. The beverage container according to claim 22 further comprising a buoyant member associated with each of said straw and prize delivery device, said buoyant member elevating said straw through said orifice when said straw is aligned with said orifice and elevating said prize delivery device through said orifice when said straw is aligned with said orifice.

24. The beverage container according to claim 13 wherein, said prize delivery device includes an internal volume for supporting a prize or prize notification material therein.

25. The beverage container according to claim 13 wherein, said straw and prize delivery device contain information instructing a user of said beverage container how to recover the other of said straw and prize delivery device.

26. The beverage container according to claim 13 wherein, said container includes information instructing a user of said beverage container how to recover one of said straw and prize delivery device.

* * * * *